United States Patent [19]

Tamai

[11] Patent Number: 4,479,773

[45] Date of Patent: Oct. 30, 1984

[54] COMBUSTION METHOD AND DEVICE

[76] Inventor: Shigetake Tamai, No. 4648-90, Ikuta, Tama-ku, Kawasaki-shi, Kanagawa, Japan

[21] Appl. No.: 195,803

[22] Filed: Oct. 10, 1980

[30] Foreign Application Priority Data

Jun. 23, 1980 [JP] Japan ..... 55-83977

[51] Int. Cl.[3] ..... F23Q 9/00

[52] U.S. Cl. ..... 431/9; 239/403; 239/405

[58] Field of Search ..... 239/403, 405, 406; 431/9, 182, 183, 185

[56] References Cited

U.S. PATENT DOCUMENTS 3,223,394 12/1965 Walsh ..... 239/405

3,887,135 6/1975 Tamai ..... 239/406

*Primary Examiner*—Samuel Scott

*Assistant Examiner*—Noah Kamen

*Attorney, Agent, or Firm*—Sughrue, Mion, Zinn, Macpeak, and Seas

[57] ABSTRACT

A combustion method using an inventive combustion principle in which liquid fuel is atomized by the flow of gas jetted from the flow paths of a nozzle which are formed by flow lines extending to the sink point of dipole in potential motion. Thermodynamic principles are applied to the motion of the gas for the burning of the spirally rotating gas flow which is formed by the mixture of fuel and gas. The combustion efficiency and the heat exchanging efficiency are remarkably improved. The invention also relates to a device for practicing the method.

2 Claims, 8 Drawing Figures

COMBUSTION METHOD AND DEVICE

BACKGROUND OF THE INVENTION

In a conventional combustion method, combustion is carried out with the aid of a flow of gas formed in a field such that $\nabla \times \omega \neq 0$. At present, in order to atomize liquid fuel, a method in which differences in the speeds of fuel and gas are used and a method of directly atomizing fuel by applying pressure thereto are employed. In both of the conventional methods, it is necessary to use a high speed gas flow which is an oxygen source and an atomizing device to burn the fuel. The high speed gas flow accelerates dissipation of heat generated by combustion and of unburned gas and the expansion of gas due to increased temperature increases the amount of external work thus increasing the dissipation of energy to the atmosphere with the result that an excessive amount of fuel is needed to obtain high temperatures. The gas flow is originally unstable. That is, it is unstable in mass and therefore a suitable air-fuel mixing ratio cannot be obtained.

In addition, during combustion, a cooling gas flow is introduced due to convection so that the density, speed and temperature of the gas flow change spatially and with time with the result that temperature change of combustion is uneven. A gas flow where speed is higher in outer than in inner portions makes it impossible for centrifugal force to atomize fuel flowing out to the focal point of the nozzle and, accordingly, the speed difference of the fuel and gas must be employed for atomizing the fuel. In this case, the fuel is only roughly atomized which lowers the combustion efficiency. That is, in combustion using the above-described gas flow, non-adiabatic changes take place in which the entropy is increased making it difficult to improve the combustion efficiency from thermodynamics considerations and the combustion efficiency is much lower than the very high combusion efficiency obtainable with an adiabatic reversible change.

SUMMARY OF THE INVENTION

With a view of overcoming the above-mentioned difficulties, the invention provides a method for burning a rotating gas at a suitable mixture ratio of air and fuel jetted at the focal point of a nozzle of a dipole including the steps of providing a gas motion in an adiabatic reversible change in which pressure reduction in vortex motion due to combustion provides an advancing gas flow applied to a vortex, applying a pressure impulse to the vortex motion, and decreasing the advancing speed of the vortex by an amount equivalent to the speed of rotation of the vortex due to the nonambiguity of the pressure impulse and speed potential so that a plane equivalent in pressure to the atmospheric pressure is moved inwardly to contract a combustion region thereby to form a combusion region of maximum energy density. The gas mixture jetted at the focal point of the nozzle is completely burned with the aid of the centrifugal force of a high speed rotating gas due to the impact of the pressure impulse so that the flame of the mixture gas is maintained continuously to form a safe combusion region. The maximum possible internal energy is obtained from thermal energy generated by combustion and thermal energy upon adiabatic contraction. An atomization region is contracted by combustion into a region of maximum internal energy and an extremely high combustion efficiency is provided with the aid of temperatures before and after combustion. The heat exchange efficiency of a heat exchanger is increased by the thermal conduction of gas in potential motion due to combustion in an adiabatic reversible change.

Yet further, the invention provides a combustion device having an atomizing nozzle including means for forming a plurality of gas flow paths each of which is formed by coaxially arranging two different circular truncated cones having a common vertex and by projecting two different flow paths among flow lines extending to the sink point of a dipole onto the surfaces of the circular truncated cones to form the upper and lower bases of the cone. The gas flow paths are arranged in such a manner that the focal point of the gas flow paths coincides with the sink point of the dipole at the vertex of the circular truncated cones. A fuel path is provided extending straightly along the axis of the circular truncated cones in such a manner that the axis of the fuel path passes through the focal point wherein the fuel atomized at the focal point is burned only in a conical region which is formed by gas flows which run along the gas flow paths to concentrate at the focal point. Still further, there may be provided in the combustion device of the invention a fuel control tank which is hermetically sealed and has a space for fuel and a space above the fuel. The fuel control tank includes a fuel supplying pipe inserted into the fuel control tank in such a manner that the upper end of the fuel supplying pipe is at the same level as the axis of the nozzle and an air pipe inserted into the fuel control tank in such a manner that the upper end of the air pipe communicates with atmospheric pressure and the lower end of the air pipe is movable vertically below the upper end of the fuel supplying pipe wherein fuel at a negative head due to a vertical distance between the upper end of the fuel supplying pipe and the lower end of the air pipe is supplied to the nozzle to thereby obtain a suitable mixture ratio of air and fuel.

DESCRIPTION OF THE PREFERRED EMBODIMENTS

Figure 1:
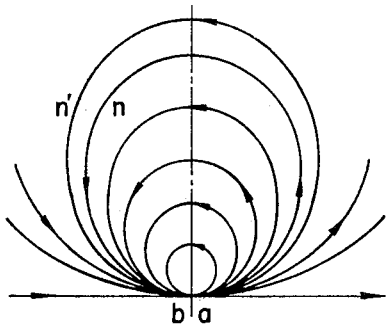
FIG. 1 is a diagram showing two-dimensional flow lines of a dipole forming spiral flow paths according to the invention.

In accordance with the invention, combustion is carried out by an adiabatic reversible change of a rotating gas flow in potential motion which occurs in a field in which $\nabla \times \omega = 0$ in which the motion of the gas flow is fundamentally different from that involved in a non-adiabatic reversible change in which $\nabla \times \omega \neq 0$. In accordance with the invention, a novel nozzle is employed which is obtained by improving the gas flow dipole paths of a nozzle of the basic type disclosed by Japanese Pat. No. 776971, U.S. Pat. No. 3,887,135 and British Pat. No. 1459097. Fuel is atomized by flows of air jetted from the inventive nozzle into a gas mixture having a suitable air-fuel mixture ratio. The gas mixture is moved spirally as indicated by the arrows 8 in FIG. 4 in a confined conical region the vertex of which coincides with the focal point of the nozzle. In this operation, a planar vortex perpendicular to the axis of the nozzle and an advancing gas flow parallel to the axis of the nozzle are formed as components of the gas flow.

Variations in motion of the vortex and of the advancing gas flow have been investigated by the applicant using principles of hydrodynamics and thermodynamics to discover the combustion mechanism which is due to adiabatic reversible change and to accordingly acheive highly improved combustion efficiency and heat exchange efficiency.

A gas flow having a vortex motion and a gas flow having an advancing motion based on the above-described dipole flow path may be considered as one system. In this case, a balance of energy is established for the system. Because of this balance of energy, in the conversion of matter, potential energy is abruptly decreased by generation of thermal energy and therefore the vortex absorbs the advancing gas flow and a pressure impulse is applied to the vortex motion. As a result, the vortex in steady motion is changed into one in non-steady motion by combusion and therefore a dynamic balance is established between the vortex and the advancing gas flow. The rotating gas flow in non-steady motion can be represented by the Bernoulli's general equation.

In that equation, the terms $\partial\psi/\partial t$ and $p/\rho$ due to the pressure impulse are much larger than the terms U and $\omega^2/2$. Therefore, with the terms U and $\omega^2/2$ neglected, Bernoulli's general equation can be rewritten as the following equation (1) (cf. hydrodynamics for the Bernoulli's general equation and the pressure impulse):

$$\frac{\partial\psi}{\partial t} + \frac{p}{\rho} = f(t). \tag{1}$$

The first law of thermodynamics is applied to the equation (1) yielding:

$$\frac{\partial\psi}{\partial t} + kT = f(t). \tag{2}$$

For non-steady motion, the value $\rho$ is a function of the value p. Therefore, from equations (1) and (2), linear functional relations are established for pressure, potential and temperature. The following pressure impulse indicating equation (3) is obtained by integrating the equation (1):

$$\psi(t) + \frac{1}{\rho} \int_0^t p\,dt = \text{Konst.} \tag{3}$$

The second term in the equation (3) is the sum of pressure acting for a period of time t with the steady state as zero, that is, the pressure impulse. When a large pressure impulse is applied to the vortex motion, the gradient of the pressure impulse is increased as a result of which the value $\rho\omega$ increases. The flow of potential is a mass flow and is therefore represented by the product of $\rho$ and $\omega$. Thus, if the gradient of pressure impulse increases with temperature, the flow of potential also increases. Accordingly, as the vortex increases the flow of potential $\rho_1\omega_1$ with temperature, the flow of potential $\rho_2\omega_2$ of the advancing gas flow is decreased.

As is clear from equation (3), the density $\rho$ is represented by the ratio of pressure impulse to speed potential. Therefore, the value $\rho$ is a function of the potential $\psi$ because of the nonambiguity of p and $\psi$. Therefore, in the flow of potential $\rho_1\omega_1$, a proportional relation is established between the values $\rho_1$ and $\omega_1$ and similarly a proportional relation is established for the flow of potential $\rho_2\omega_2$ of the advancing gas flow. Therefore, if the vortex increases the flow of potential, then the vortex also increases the rotating speed $\omega_1$ while the advancing gas flow decreases the speed $\omega_2$.

In the case where the vortex increases the flow of potential $\rho_1\omega_1$ with temperature and increase the rotating speed $\omega_1$, because of the relationship of vortex motion ($\omega r = C$), as the vortex increases the rotating speed $\omega_1$, the radius $r_1$ is decreased in inverse proportion to the speed. On the other hand, the speed $\omega_2$ of the advancing gas flow following this decreases and the isobaric surface which is provided by the equilibrium between the atmospheric pressure and the flow of gas jetted by the nozzle is moved inwardly. The atomization region is decreased in an adiabatic reversible mode without increasing the entropy thereof forming a minimum-sized combustion region of maximum energy density in which complete combustion is achieved.

The flow of gas which is high in temperature and is rotating at a high speed due to the pressure impulse imparts to the fuel jetted from the focus of the nozzle an extremely great centrifugal force proportional to the square of the speed so as to momentarily atomize the fuel and to completely burn the fuel. Accordingly, the flame during combustion does not flicker at all. That is, the flame is dynamically balanced and the combustion region is the always maintained stable.

Described above have been the features of the motion of gas in the case where the rotating flow of the gas mixture due to the dipole carries out an adiabatic reversible change with the aid of a pressure impulse. A specific feature of the principle of thermal energy production according to the invention resides in that combustion during an adiabatic reversible change yields thermal energy produced by material conversion to the flow of potential, further, thermal energy which is produced during an adiabatic contraction to the flow of potential, and the internal energy in the combustion system is maximized whereby a new high-temperature heat source of very high efficency is obtained for potential motion.

The combustion efficency $\eta$ provided with the use of the invention is determined as follows. If the internal energy of a mixture gas before combustion is represented by $Q_0$, the internal energy due to material conversion after combustion by $Q_1$, the amount of work done during adiabatic contraction by $Q_2$, and the entropy by S, then $Q = ST$ and the temperature after combusion is represented by $T_1 + T_2$. Therefore, $$\eta = 1 - \frac{T_0}{T_1 + T_2}. \tag{4}$$

Thus, an important feature of the invention resides in that a combustion mechanism is developed for providing maximum internal energy by combustion during an adiabatic reversible change with the aid of a pressure impulse. In accordance with the invention, a method is provided for obtaining an extremely high efficiency from gas temperatures before and after combustion.

Figure 6A:
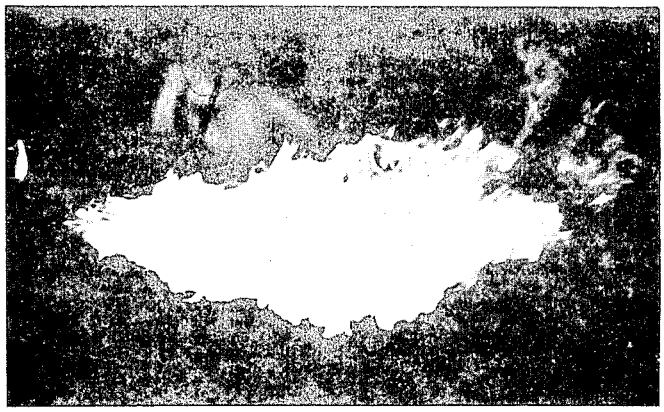
FIG. 6A is a photograph showing the conditions of a flame with the nozzle according to the invention and FIG. 6B is a photograph showing the conditions of a flame with a conventional gun type burner.
Figure 6B:
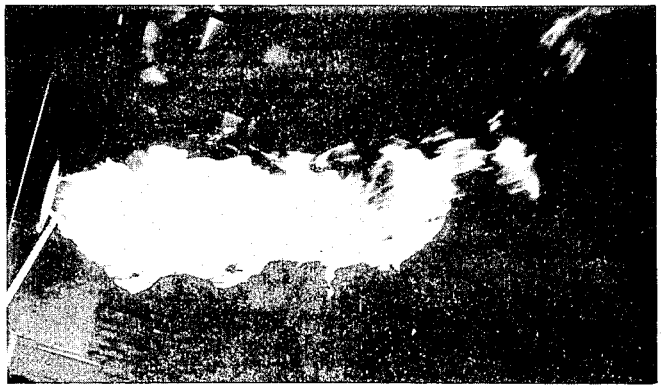

The following data represent the results of comparison experiments of a device constructed according to the invention and a conventional gun type burner both using a flame about 1 m in length and about 30 cm in maximum diameter. The combustion efficiencies of the device of the invention and of the gun type burner are approximately as follows:

Temperature of fuel (kerosene) and room temperature: 10° C.=283° K.
Nozzle air pressure (invention): 2.5 Kg/cm$^2$
Nozzle fuel outlet diameter (invention): 9 mm
Nozzle fuel head (invention): −2 cm
Fuel consumption:
  Invention: 7.4 l/h
  Gun type burner: 20.0 l/h
Experimental results:
  Flame approximate average temperature:
    Invention: 1270° K.
    Gun type burner: 1170° K.
  Combustion efficiency from equation (4):
    Invention: 78%
    Gun type burner: 70%
  Efficiency calculated from fuel consumption:
    Invention: $\eta=78\%$
    Gun type burner: $\eta=70=(7.4/20)=26\%$ The combustion efficiency for a unit quantity of fuel was found to be 78% with the device of the invention and 26% with the conventional gun type burner. Thus, the combustion efficiency of the device of the invention is about three times higher than that of the conventional gun type burner. FIG. 6A is a photograph showing the flame produced with the device of the invention while FIG. 6B shows the flame with the conventional gun type burner.

According to several experiments performed using a nozzle air pressure of 2 to 3 Kg/cm$^2$ and a nozzle fuel head of −2 to −3 cm, it was found that as the nozzle fuel outlet diameter is increased, the combustion efficiency is increased. Even with a nozzle fuel outlet diameter of 20 mm, a high degree of combustion was carried out.

A conventional heat exchange method utilizes the thermal conduction of diverging high speed gas for which $\nabla\times\omega\neq0$. On the other hand, in the heat exchange method according to the invention, high temperature thermal conduction is obtained by the slow movement of diffusible gas due to potential motion with $\nabla\times\omega=0$ which is provided with the aid of the above-described adiabatic reversible change. Thus, the conventional heat exchange method is fundamentally different in principle from the heat exchange method of the invention. With the invention, a nozzle is used which introduces gas which has been completely burned during an adiabatic reversible change into a boiler or other suitable device so that the heat content of the slowly moving high temperature gas is transferred to the boiler or other suitable device to thereby improve the heat exchange efficiencies thereof. In other words, in accordance with the method of the invention, heat exchange is carried out utilizing the diffusion of the gas itself. For this purpose, an exhaust pipe or a suction device in combination with the exhaust pipe is used to control the temperature and speed of the gas so that the heat exchange efficiency of the device of the invention is remarkably improved by the high temperature gas moving at a slow speed as compared with a conventional device.

Furthermore, if a rotating flow of gas in potential motion according to the invention is introduced into the cylinder of an internal combustion engine, the mechanical energy potential is increased and therefore the combustion efficiency of the internal combustion engine is increased to a high degree.

Figure 2:
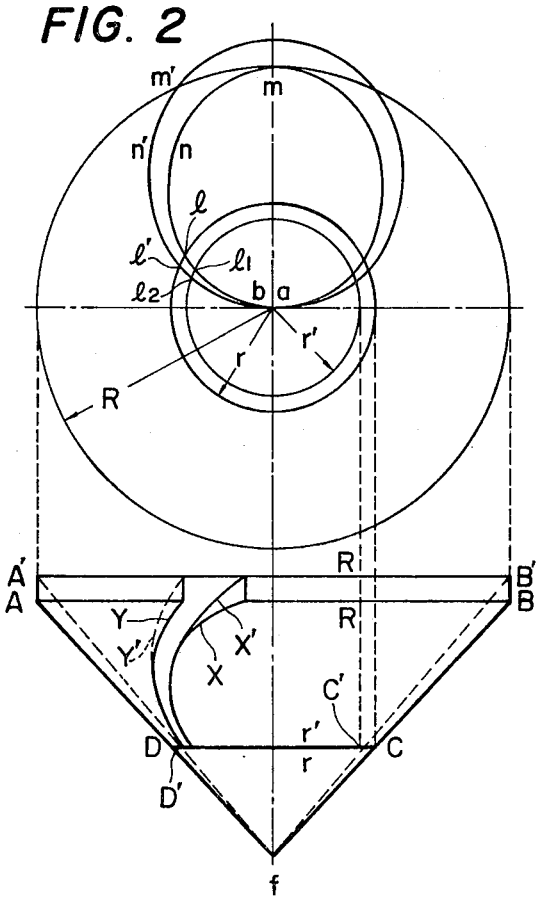
FIG. 2 is a diagram for a description of a method of forming the spiral flow paths on the conical surface of a nozzle in the form of a circular truncated cone.
Figure 5:
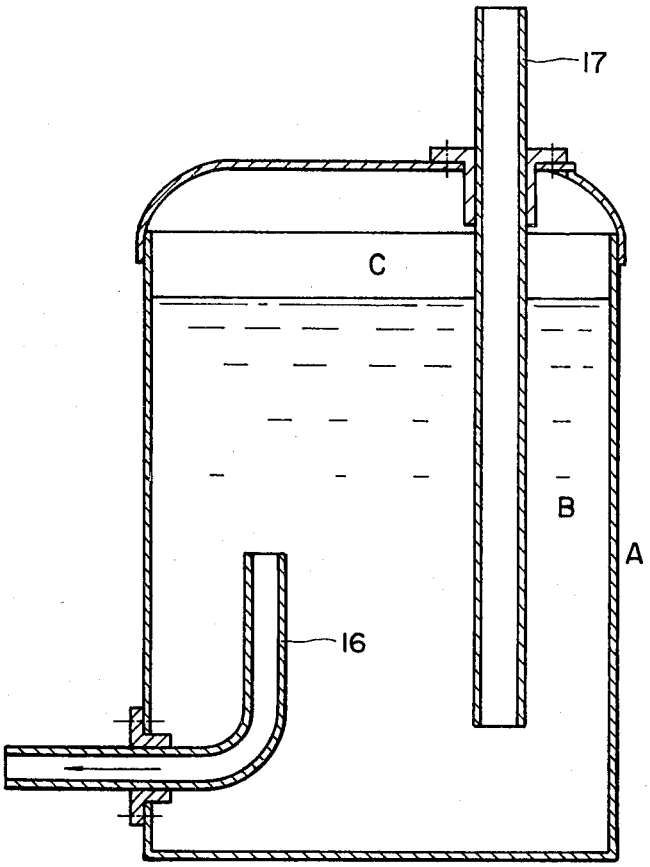
FIG. 5 is an explanatory diagram showing the arrangement of a fuel control tank constructed according to the invention.

The method of the invention cannot be practiced with a nozzle having spiral flow paths such as described in FIG. 2 of Japanese Utility Model No. 1175576, FIG. 5 of Japanese Pat. No. 776971, U.S. Pat. No. 3,887,135 or FIG. 5 of British Pat. No. 1459097 because of the following reason. As the intersection of gas flows in the upper layer in the flow path of the nozzle is shifted from the intersection of gas flows in the lower layer, the blowing gas and the sucked gas interfere with each other as a result of which unstable or non-steady motion occurs with the flow of gas. That is, the flow of gas becomes a turbulent flow. This disturbs the establishment of a linear relationship for pressure, potential and temperature which are essential combustion conditions in the invention and therefore the desired high combustion efficiency cannot be achieved.

Accordingly, a combustion device according to the invention includes an accurate nozzle for concentrating the flow of gas at its true focus (the sink point of dipole) and a fuel control tank for maintaining the fuel head negative with respect to a given air pressure applied to the nozzle to freely supply fuel at a suitable mixing ratio so as to eliminate the mutual interference of gas flows and to provide a suitable mixing ratio of air and fuel thereby to carry out high temperature combustion. The improved nozzle, the fuel control tank and the overall device of the invention will be described with reference to the accompanying drawings.

FIG. 1 shows the flow of a two-dimensional dipole potential when a number of flow lines starting at a source point a return along predetermined orbits to a sink point b. In FIG. 1, reference characters n and n′ designate the particular flow lines which are selected to form a spiral gas flow path according to the invention. FIG. 2 illustrates the formation of a spiral flow path. As shown in FIG. 2, two circular truncated cones ABCD and A′B′C′D′ having a common focal point or vertex have lower bases both of radii R and upper bases of radii r and r′, respectively. The two circular truncated cones are arranged coaxially so that a projection of the focal point f coincides with the sink point b on the plane of the dipole. A circle of radius R is described touching the flow line n at a point m and intersecting the flow line n′ at a point m′. Then, circles are described with the radii r and r′ of the upper bases with the circle of radius r intersecting the flow lines n and n′ at points l and l′. Thus, the projection of a flow path which forms the surface part of the sprial flow path is obtained on a plane by the limited flow lines ml and m′l′. Similarly, the projection of the lower base of the spiral flow path is obtained by the flow lines $ml_1$ and $m'l_2$. With curves obtained by transferring the flow lines ml and m′l′ onto the surface of the circular truncated cones ABCD designated by X and Y, respectively, and curves obtained by transferring the flow lines $ml_1$ and $m'l_2$ onto the surface of the circular truncated cones A′B′C′D′ designated by X' and Y', respectively, both walls of the spiral flow path are defined by the curves X and X', and Y and Y', respectively.

Figure 3A:
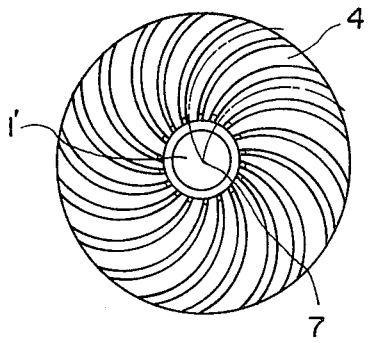
FIG. 3A is a front view of the nozzle and FIG. 3B is a side view, partly as a sectional view, of the nozzle.
Figure 3B:
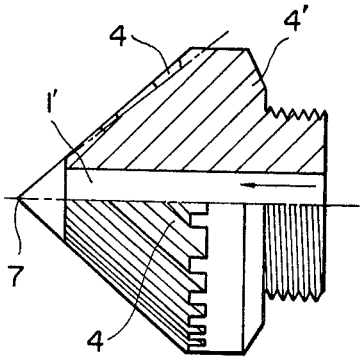

The nozzles of the invention is designed so that, as shown in FIG. 3A which is a front view of the nozzle and in FIG. 3B which is a side view partly as a sectional view of the nozzle, a number of spiral flow paths thus formed are symmetrically arranged on the surface of the nozzle in such a manner as to surround the fuel outlet 1'. The focus of these flow paths coincides with the vertex of the nozzle.

With the nozzle constructed as described above, all of the flows of gas along the flow paths are concentrated at the focal point or sink point of dipole and therefore the mutual interference of groups of gas flows in the vicinity of the focal point in the conventional nozzle are completely eliminated. The flow of gas in a spiral motion with a stable suction action provides a maximum torque to fuel jetted to the focal point to atomize the fuel to a high degree thus improving the function of atomizing fuel of the nozzle.

Figure 4:
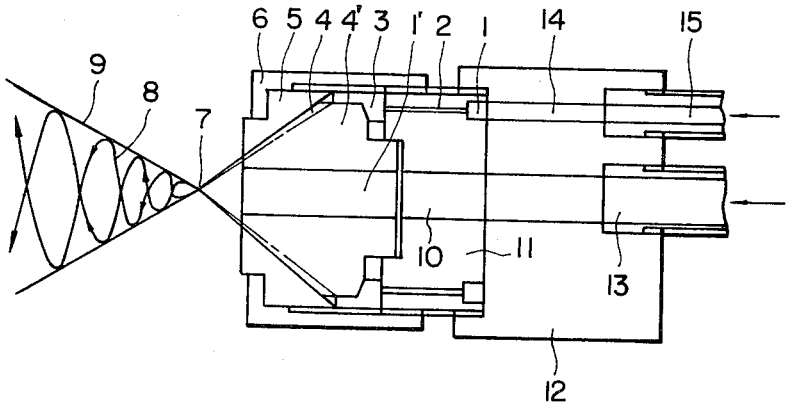
FIG. 4 is a sectional view showing the construction of a part of a combustion device according to the invention which is provided with the nozzle.

FIG. 4 is a sectional view of a part of a combustion device according to the invention including a nozzle of the invention and from which the fuel control tank has been removed. A fuel supplying main pipe 13 is connected to a fuel flow path 10 which extends to the fuel outlet 1' of the nozzle along the axis of a body 12 and an air distributor 11. Fuel is supplied from the fuel control tank to the fuel outlet 1' of the nozzle 4' by the suction action at the focal point of the nozzle 4'. Compressed air is introduced through an air supplying pipe 15 and an air path 14 into a ring-shaped groove 1. The compressed air in the ring-shaped groove 1 is further caused to flow through small paths 2 in the air distributor 11 which are screwed into the body 12, forming a gas-tight seal therewith, and into an air chamber 3. The compressed air thus introduced into the air chamber 3 is regulated into flows of air which flow along the spiral flow paths 4 which are formed symmetrically on the surface of the nozzle. Accordingly, the flows of air are forcibly moved spirally to concentrate at the focal point 7 of the sink point 7 of dipole of the nozzle. A cover 5 is in close contact with the surface of the nozzle thus forming a wall for the spiral flow paths 4.

The gas mixture jetted at the focal point carries out potential motion along a number of spiral orbits 8 in a limited conical region 9 with the focal point as its vertex. That is, the mixture moves stably spirally.

A specific advantageous feature of the fuel control tank of the invention resides in that the fuel supplying pipe 16 (FIG. 5) is arranged so that its upper end is at the same level as that of the central axis of the nozzle and fuel is supplied at a suitable mixture ratio to the nozzle with the fuel head maintained negative for a given nozzle air pressure.

FIG. 5 shows the structure of a fuel control tank having the aforementioned fuel supplying pipe 16. A tank A is hermetically sealed with a space C provided above the fuel B in the tank A. An air pipe 17 is inserted into the fuel B in such a manner that it communicates with the atmosphere through the upper end so that the atmospheric pressure is maintained at the lower end. A negative fuel head can be freely selected depending on the vertical distance between the upper end of the fuel supplying pipe 16 and the lower end of the air pipe 17 by vertically moving the lower end of the air pipe below the upper end of the fuel supplying pipe 6. Thus, if the vertical distance and accordingly the negative fuel head is adjusted with respect to a given air pressure while the conditions of the flame are being observed, an optimum mixing ratio can be established for the air pressure and fuel supplied to the nozzle.

The other end of the fuel supplying pipe 16 is connected through a flexible pipe to the fuel supplying main pipe 13 connected to the body of the nozzle. If switching of the fuel control tank is carried out between tanks situated at the same level, the combustion may still be continuously carried out. That is, high temperatures combustion with an extremely high efficiency can be carried out with a minimum quantity of fuel according to the invention. For suction-type combustion due to a negative head, the supply of fuel is automatically suspended by interrupting the supply of air pressure to the nozzle. Therefore, the occurrence of back fire due to the leakage of fuel in the conventional method is positively prevented with the invention which contributes to the improvement of safety of the device in operation.

According to the invention, utilizing the principle of combustion due to adiabatic reversible change, combustible material can be completely burned irrespective of its molecular weight and mixing ratio. Therefore, a variety of fuels can be effectively utilized in a wide range of applications and the combustion efficiency of internal combustion engines can be remarkably increased according to the invention thereby contributing to the economical use of energy.

What is claimed is:

1. A combustion device having an atomizing nozzle comprising:

means for forming a plurality of gas flow paths each of which is formed by coaxially arranging two different circular truncated cones having a common vertex and by projecting two different flow paths among flow lines extending to the sink point of a dipole onto the surfaces of said circular truncated cones to form upper and lower bases thereof, said gas flow paths being arranged in such a manner that the focal point of said gas flow paths coincides with the sink point of said dipole at the vertex of said circular truncated cones; and a fuel path extending straightly along the axis of said circular truncated cones in such a manner that the axis of said fuel path passes through said focal point wherein fuel atomized at said focal point is burned only in a conical region which is formed by gas flows which run along said gas flow paths to concentrate at said focal point.

2. The device as claimed in claim 1 further comprising: a fuel control tank which is hermetically sealed and having a space for fuel and a space above said fuel, said fuel control tank having a fuel supplying pipe inserted into said fuel control tank in such a manner that the upper end of said fuel supplying pipe is at the same level as the axis of said nozzle; and an air pipe inserted into said fuel control tank in such a manner that the upper end of said air pipe is communicated with atmospheric pressure and the lower end of said air pipe is movable vertically below the upper end of said fuel supplying pipe wherein fuel at a negative head due to a vertical distance between the upper end of said fuel supplying pipe and the lower end of said air pipe is supplied to said nozzle to obtain a suitable mixture ratio of air and fuel.

* * * * *